US005509234A

United States Patent [19]

Klimek et al.

[11] Patent Number: 5,509,234

[45] Date of Patent: Apr. 23, 1996

[54] WINDOW OPERATOR ASSEMBLY

[75] Inventors: David J. Klimek, Wausau, Wis.; Thomas Wright, Rockford, Ill.

[73] Assignee: SNE Enterprises, Inc., New York, N.Y.

[21] Appl. No.: 307,243

[22] Filed: Sep. 16, 1994

[51] Int. Cl.[6] ..... E05F 11/24

[52] U.S. Cl. ..... 49/342; 49/344; 49/346

[58] Field of Search ..... 49/342, 341, 340, 49/344, 346

[56] References Cited

U.S. PATENT DOCUMENTS

| | | | |
|---|---|---|---|
| 1,924,557 | 8/1933 | Johnson | 49/341 |
| 1,982,269 | 11/1934 | Schaffert et al. | 49/342 |
| 2,576,536 | 11/1951 | Reynaud | 49/342 X |

*Primary Examiner*—Philip C. Kannan
*Attorney, Agent, or Firm*—Gerald S. Geren

[57] ABSTRACT

An operator assembly for a casement window that includes a frame and a pane carrying sash. The operator assembly is mounted to the frame and an elongated arm connects the operator assembly and the sash. Movement of the arm moves the sash relative to the frame for opening and closing the window. The operator arm includes a pivotally mounted and linerally moveable handle which is moveable between a first and second position. A ratchet-type gearing system is provided to connect the handle and operator arm and to effect movement of the operator arm in response to movement of the handle. A selector associated with the handle and gearing system is provided to effect and control the direction of sash movement in response to the movements by the handle. A locking system is provided to engage the gearing system to prevent movement of the gearing system due to loads on the sash that are transmitted to the gearing system through the sash and operator arm. The locking system is biased to an engaged position but is disengaged by movement of the actuator handle and a device associated therewith.

17 Claims, 3 Drawing Sheets

Fig. 1
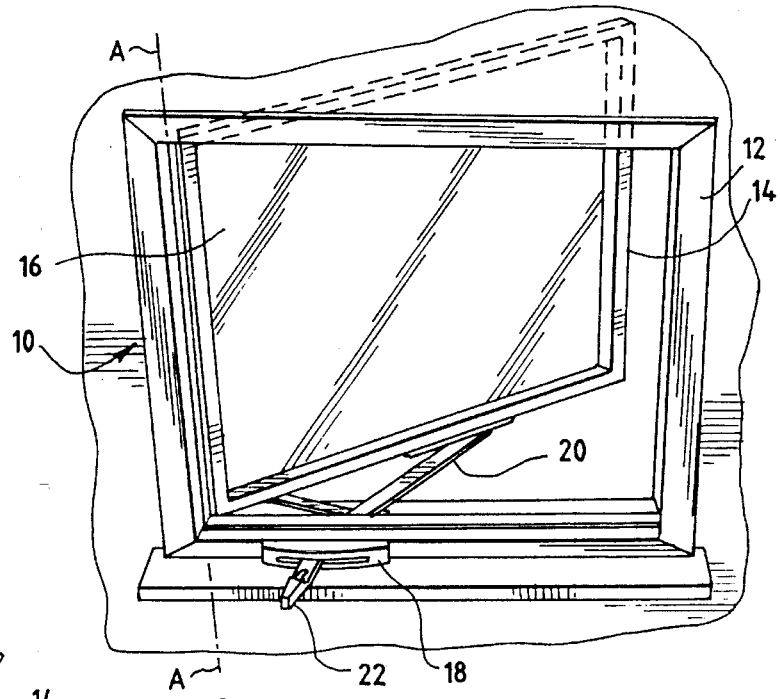
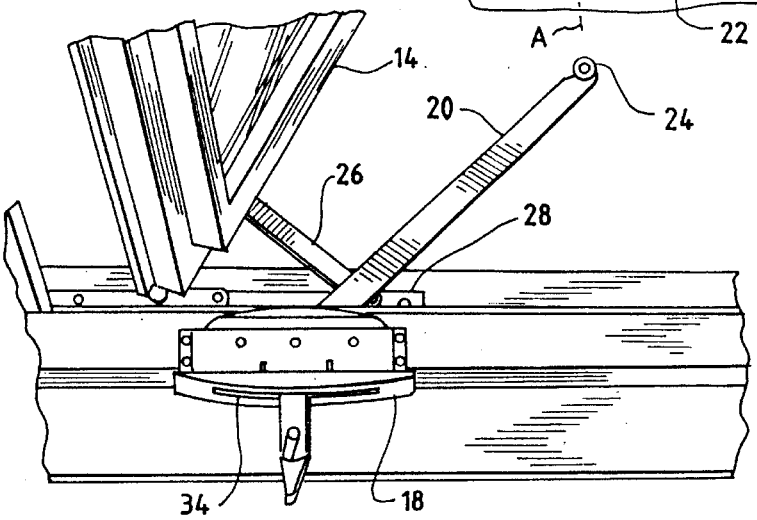
Fig. 2
Fig. 3
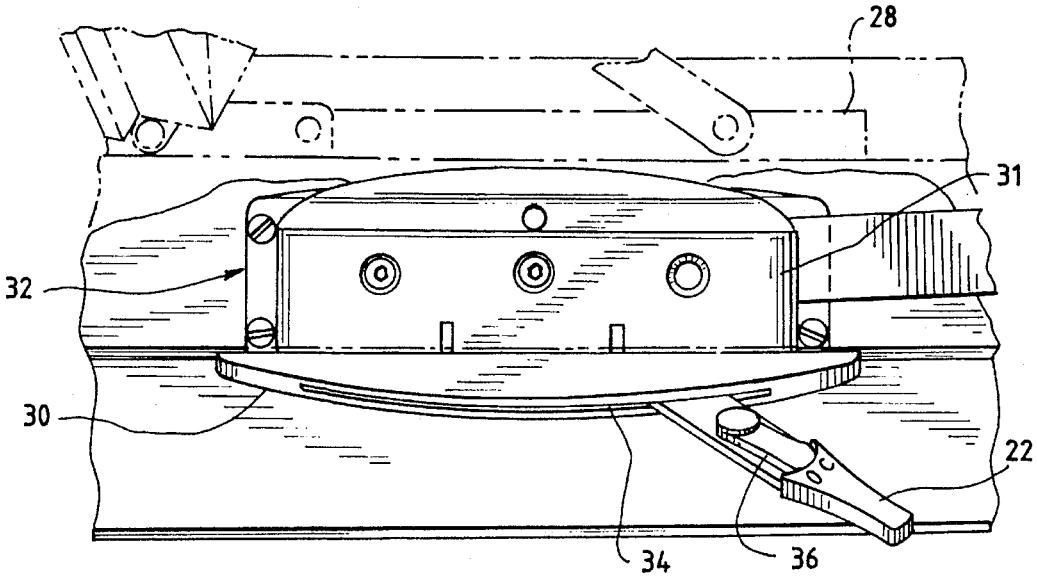

Fig. 4
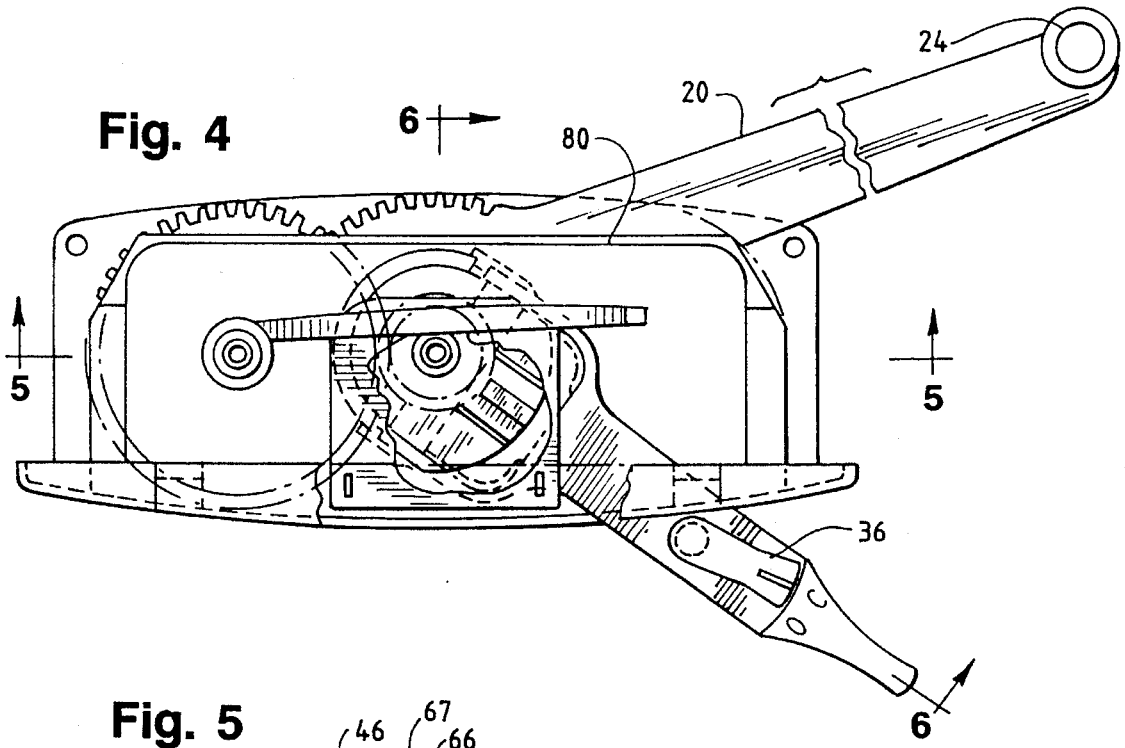
Fig. 5
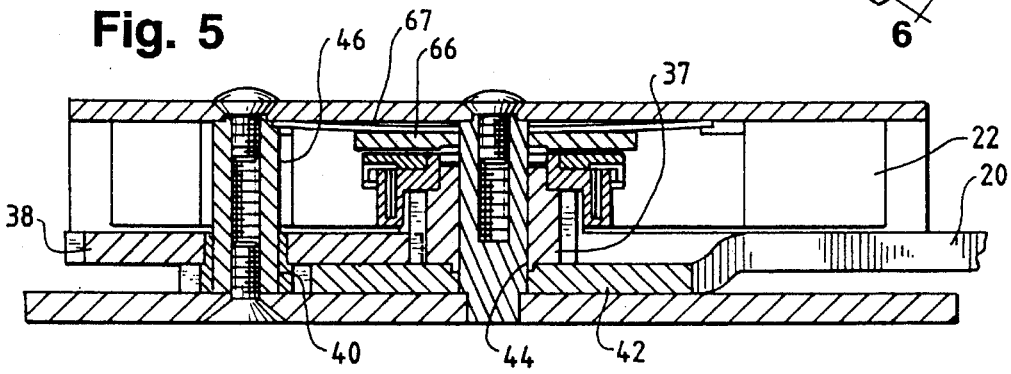
Fig. 6
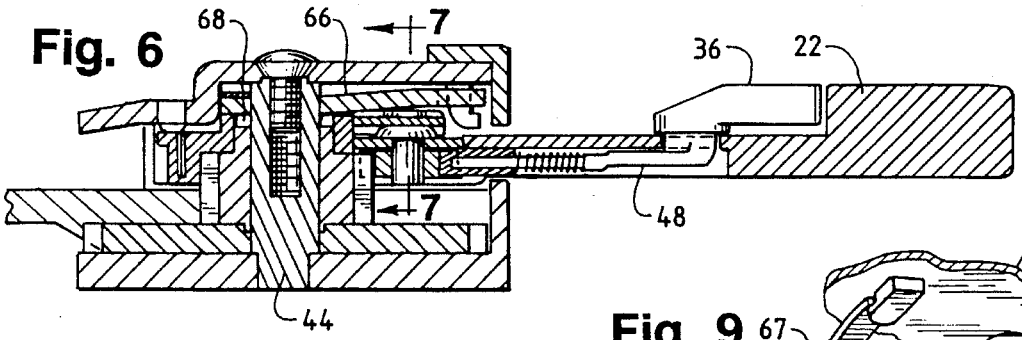
Fig. 9
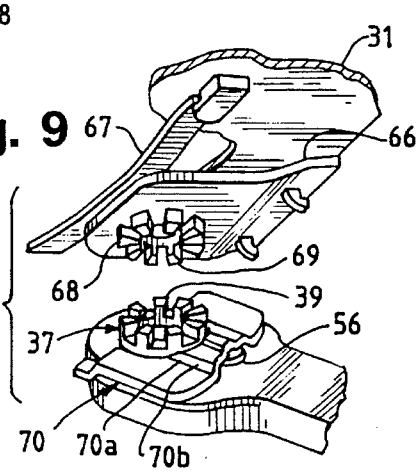
Fig. 7
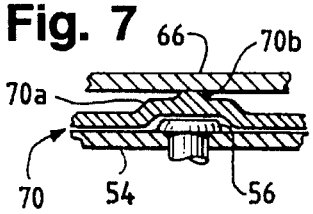
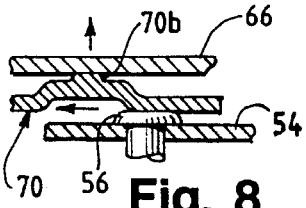
Fig. 8

WINDOW OPERATOR ASSEMBLY

BACKGROUND OF THE INVENTION

This invention relates to swinging windows of the casement or awning style and more particularly, to an operator assembly of the type used to open and/or close the window.

Casement and awning style windows have been and are popular. Such a window is shown in U.S. Pat. No. 4,837,977, Mauro. In a casement window, there is a frame which is fixed in an opening in a building. The window includes a sash, which carries a pane that is mounted to the frame about an axis usually along one side of the sash and the frame. To open or close the window, the sash is pivoted about the axis. The sash is swung open and closed about the pivot axis by an operator arm which is secured at one end to the sash and at the other end to an operator assembly associated with the frame. The operator assembly includes a handle for moving the operator arm in response to a user's actions. The operator assembly is secured to the frame on the inside of the window so as to permit the sash to swing on the outside between a closed position against the frame and open position away from the frame.

Many operator assemblies are crank style devices, where a handle rotatable about an axis oblique to the frame and operates a gear train that moves the arm to open or close the sash.

A disadvantage to crank style operator assemblies is the rotary motion of the handle and the distance the operator handle extends from the frame into the room. This may be manifested by handle interference with draperies or blinds.

Thus, it is an object of this invention to provide a system for opening and closing a casement or awning style window, which is not of the crank style and whose inward extent is minimized.

In the crank style system, the handle may obstruct the removal and installation of a screen accessory or hinder cleaning of the pane.

Thus, it is another object of this invention to provide an operator assembly with a handle that is not obstructive.

In some situations a linear style or linearly movable operator assembly has been used. But these assemblies require large amounts of force to operate or may open the sash only to a limited extent, rather than the full extent (i.e. 45 degrees rather than 90 degrees).

Thus, another object of this invention is to provide an operator assembly that has a linearly movable handle which has a high degree of mechanical advantage and permits a full range of sash motion.

It is also been found that in some positions the handle may be difficult to use, especially for older people, particularly if they suffer from arthritis or similar diseases.

Yet another object is to provide an operator with a handle that is easy to use and which exhibits a high degree of mechanical advantage.

Sometimes the crank style handle may be difficult to rotate depending upon its position, and thus be uneven to use and may cause the user's knuckles to strike the sill.

A further object of this invention is to provide an operator with a handle that is easy and convenient to use and is not position sensitive.

These and other objects of this invention will become apparent from the following disclosure and appended claims.

SUMMARY OF THE INVENTION

There is provided by this invention a ratchet-style operator assembly which includes a handle that, although pivotally mounted, has a linear-style to its motion.

The operator assembly is mounted to the frame, is not obtrusive, is easy and convenient to use, exhibits a high degree of mechanical advantage so as to be capable of smooth operation and includes a handle whose movement is parallel to the frame and of a linear style. The handle includes a pawl mechanism that engages a ratchet wheel/gear that controls the direction of operation and connects the actuator handle to the gear system that in turn is connected to the operator arm and sash. The handle includes a selector that is movable between a first and a second position or vice-versa, which permits operation of the operator arm so as to open or close the sash. The linear handle movement is more convenient than the rotary movement. The handle is connected to the operator arm through a force multiplying gearing system that in effect increases the opening power.

More specifically, the handle activates a pawl that drives a ratchet wheel/gear in a clockwise or counter clockwise direction. This drives a gear system that includes a first pinion in common with ratchet wheel, that engages and rotates a first large spur gear that is commonly mounted with a second pinion, and that rotates a large spur gear which is part of the operator arm. Several strokes of the handle will open or close the sash. Operation of the selector and handle in the opposite direction causes the sash to move in the opposite direction. This gearing system provides a suitable mechanical advantage.

A lock plate is provided which is mounted to the operator housing and biased to engage the gear/ratchet wheel so as to prevent undesired movement of the operator such as caused by wind forces against the sash. A plate and cam or lease mechanism is provided in association with the lock plate to permit operation of the handle and in effect disable the locking mechanism.

BRIEF DESCRIPTION OF THE DRAWINGS

FIG. 1 is a perspective view of a casement-style window with an operator of this invention mounted to the bottom edge of the frame;

FIG. 2 is a view of a lower corner of the window showing the operator and the arm;

FIG. 3 is a plan-style view of the operator assembly and showing a slide system associated with the sash;

FIG. 4 is a plan view of the operator assembly with the top plate removed;

FIG. 5 is a sectional view of the operator assembly taken along line 5—5 of FIG. 4 but with the top plate in place;

FIG. 6 is a sectional view taken along line 6—6 of FIG. 4;

FIG. 7 is an enlarged sectional view of the top cover, locking plate, and pawl mechanism pivot and taken substantially along line 7—7 of FIG. 6 with the locking mechanism operative;

FIG. 8 is a view like FIG. 7 showing a change in the position with the locking mechanism being disabled;

FIG. 9 is a perspective view showing the lock plate mechanism;

DESCRIPTION OF THE PREFERRED EMBODIMENT

Background

Figure 10:
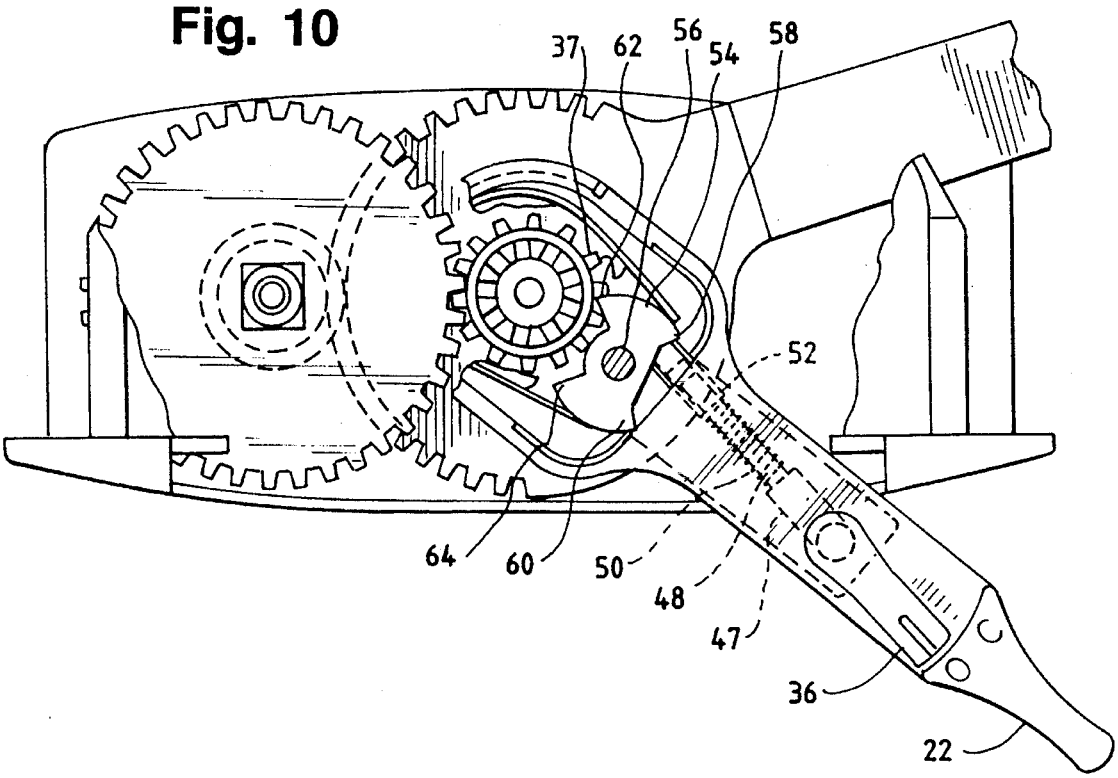
FIG. 10 is a view similar to FIG. 4 with the top cover and a bug cover removed and showing the internal operation of the operator including the ratchet wheel/gear, the pawl mechanism and the handle selection mechanism.

Referring to FIG. 1, there is shown a window 10 which includes (1) a frame 12 that is to be mounted in a building opening; (2) a sash 14 that is pivotally mounted to the frame along axis A—A; and (3) a transparent pane 16 mounted within the sash. An operator assembly 18 is mounted to the frame and an operator arm 20 is connected to the operator assembly 18 and sash 14 for opening and closing the sash. The operator actuator or handle 22 is pivotally connected inside the assembly 18 but slides or is linearly moved from one end of the operator assembly to the other end to operate a gearing system that rotates the arm 20 so as to open or close the sash. It is noted that the handle moves essential parallel to the frame.

The Operator Assembly-Generally

Referring now to FIGS. 2 and 3, a corner of the window is shown. The operator arm 20 is pivotally connected to the operator assembly 18 at one end, and the other end includes a small roller 24 that rides in a track (not shown) at the bottom of the sash so as to cause the sash to pivot about axis A—A as the arm is moved or rotated. A second arm 26 is pivotally secured, adjacent the axis end of the sash, to the bottom of the sash and the other end of the second arm slides in track 28 that is mounted to the frame. The arms 20 and 26 and track 28 guide the movement of the sash.

The operator assembly 18 fits within and is mounted to the frame. The operator assembly includes a face plate 30, a cover plate 31, and a body portion 32. The face is exposed when the assembly is completed and includes an elongated slot 34 through which the actuator handle fits, rotates and is moveable parallel to the frame or window sill. The handle 22 includes a selector switch 36 that cooperates with the a gearing system in the body and is moveable between a window open (O) and a window closed (C) position. The operator includes a ratchet style force multiplying gear system that is housed in general within the body 32 and connects the actuator handle 22 and operator arm 20.

The Operator Gearing System and Ratchet System

The operator handle 22 is pivotally mounted about a ratchet wheel/gear combination 37. The ratchet wheel/gear combination forms a first pinion. The first pinion drives a suitable large diameter drive or spur gear 38 which rotates in common with a second pinion gear 40. The second pinion gear 40 drives a suitable second large drive or spur gear 42 which is integral with the operator arm 20. The ratchet wheel/first pinion gear and the second drive gear are mounted on a common shaft 44, but it is seen that there is a sliding connection between the ratchet wheel/gear 37 and gear 42. In other words, the ratchet wheel/gear 37 and second spur gear 42 do not rotate together or in unison. But, the first spur gear 38 and second pinion 40 are mounted on the shaft 46 and do rotate in common.

The actuator handle 22 includes the selector switch 36. The selector switch is pivotally mounted to the handle and includes collar 47 that is connected to the rod 48 that extends along the actuator handle toward the gearing system. A compression spring 50 is wound about the rod 48. The spring engages a moveable end tip 52 that engages a pawl plate 54 which is pivotally mounted to the handle 22 by headed pin 56 which forms a pivot point.

The pawl 54 includes a pair of selector shoulders 58 and 60 which are selectively engagable by the tip.

It is seen that movement of the selector 36 from open (O) to closed (C) (or visa versa) causes the collar 47, rod 48 and tip to swing from shoulder 58 to shoulder 60. In so doing, the collar 47 to tip 52 distance may shorten and then lengthen. These changes are adjusted by space in the tip and engagement is assured by spring 50.

The pawl includes a pair of gear engagement teeth 62 and 64 which are engagable with the teeth of the ratchet wheel/gear 37. Thus, by moving or stroking the handle from one end to the other, the rachet engagement teeth can engage the ratchet wheel/gear and thus move or rotate the gearing system. In general the pawl will push the gear teeth on one stroke. On the reverse stroke the pawl will skip over the gear teeth. Thus, in the view of FIG. 10, the ratchet wheel/gear 37 will be rotated in the counter clockwise direction when the handle is moved to the right. But when the handle is moved to the left, the pawl will skip over the teeth and the rod 48, tip 52 and spring 50 will adjust as is seen. The engagement tooth 62 will grab a ratchet wheel/gear tooth in one direction and will skip or ratchet in the opposite direction. The skipping movement of the pawl is accommodated or taken up by the spring 50. Movement of the actuator handle causes the pawl to move, which engages and causes the ratchet wheel/gear 37 to move. That causes the first large drive gear 38 and the second pinion gear 40 rotate, thereafter the pinion gear 40 rotates the second large drive gear 42 and the operator arm 20.

Operator Locking System

In order to prevent the sash from moving, especially closing, due to wind forces, by applying a force on the arm 20, a gearing type lock system is incorporated herein. See FIGS. 7, 8 and 9. The locking system includes a locking plate 66 that is hingedly connected to the cover 31 and surrounds the shaft 44. The plate hinges downwardly and is biased downwardly by leaf spring 67. As seen in FIG. 9 the plate includes a plurality of teeth 68 which surround an aperture 69 that allows the plate to fit into a set of gear-like teeth 39 projecting upwardly from the ratchet wheel/gear 37. The teeth 68 engage the teeth 39 as best seen from FIG. 9 so as to lock the ratchet wheel/gear 37, prevent movement thereof and thus the entire gear train. The biasing spring 67 urges the plate 66 downwardly and into locking engagement. With reference to FIG. 6, it is seen that the plates slopes or hangs downwardly and is biased downwardly by the leaf spring 67. Thus, any force applied to the operator arm 20 is transmitted through the gearing system to the gear 37, but the gearing system terminates in the engagement of teeth 39 and 68 which prevents rotation of the gearing system.

In order to permit rotation of the gearing system, or release the system for rotation, it is necessary to lift the plate 66 and teeth 68 out of engagement with the teeth 39. This is achieved by the pivot pin cover plate 70. It is seen that the cover plate 70 is coined or formed upwardly at its center **70*a* so as to, in a sense, cover the pivot pin head 56. At the top of the cover plate center 70*a* there is also provided a short cam like ridge or rib 70*b*. Reference is made to FIG. 7 where it is seen that the pin 56 rests on the pawl plate 54 and under the center section 70*a* of the plate 70 and the ridge 70*b* rides against the locking plate 66. In order to raise the plate 66 so as to disengage the teeth 39 and 68, the handle actuator 22 is moved which causes the pin 56, as shown in FIG. 8 to slide under the plate 70 thereby raising the plate 70 and the ridge 70***b* in turn raises the locking plate 66.

Thus, it is seen that the gearing mechanism can operate only under the influence of the handle actuator 22, but cannot be forced to move due to the wind loads on the sash and when the handle is not moved.

The Assembly

Figure 11:
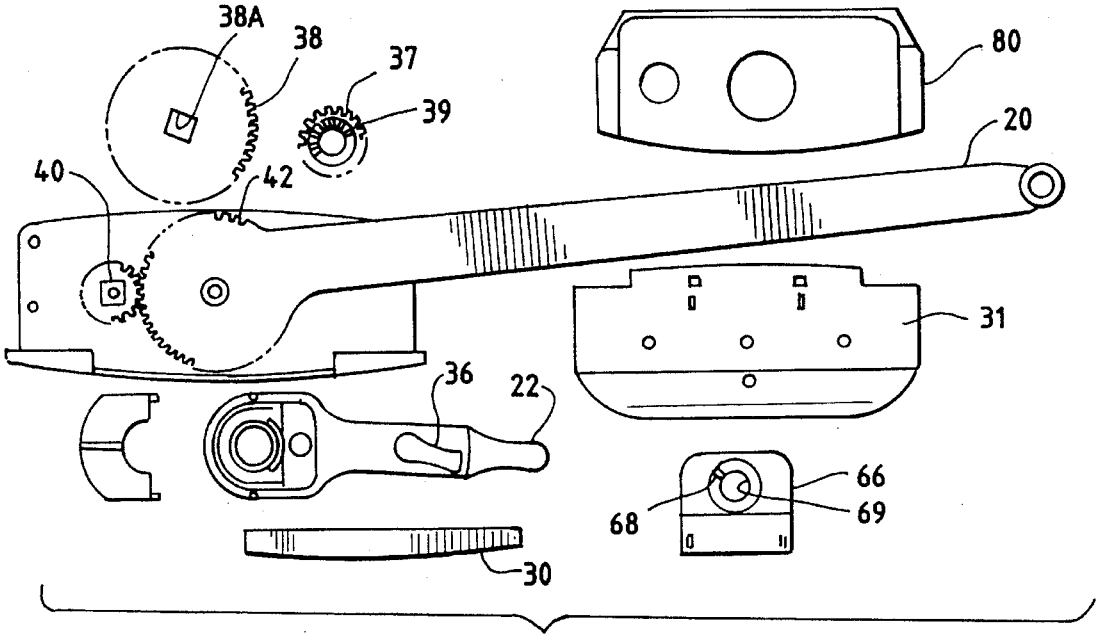
FIG. 11 is a plan view of disassembled parts of the operator.

Referring now to FIG. 11, the operator assembly is shown disassembled. An important feature of the system is a bug shield or deflector 80 which is arranged in the operator to prevent insects on the exterior from entering the house through the operator and through the exposed slot 34. It is seen from FIG. 4 that the actuator, pawl, first pinion gear and locking plate are positioned above bug shield. On the other hand, the lower part of the first pinion, the first large drive gear 38, the second pinion gear 40 and the second large drive gear 42 are positioned below the bug shield.

With reference to FIG. 11, one can see the actuator handle 22, the selector 36, the ratchet wheel and pinion combination 35, the locking gear 39. The first large spur gear 38 is shown and it is noted that it has a square bore 38*a* to match with the shaft 46. On the shaft 46, the second pinion gear 40 engages the second large spur gear 42 that is part of the operator arm. The locking plate 66 is seen as well as part of the front face 30. The cover for the entire body section 32 is also shown.

It will be appreciated that modifications and changes can be made to the foregoing embodiment without departing from the spirit and scope of this invention.

We claim as our invention:

1. An operator assembly having an operator arm for opening and closing a window having a frame and a sash pivotally secured to the frame for pivoting about an axis associated with the frame and the sash, said operator assembly comprising;

an operator body constructed for securement to a frame, and defining a first and a second position;

an elongated operator arm having one end constructed to engage a sash, the other end gearingly secured to the operator body, and constructed to move in a plane substantially transverse to a frame pivot axis;

a force multiplying gearing system positioned within said body and operatively associated with said other end of the operator arm;

an elongated graspable handle, pivotally mounted within said body for movement between the first and the second position and in a plane substantially parallel to the plane of movement of the operator arm, said handle having one end positioned within the body and operatively associated with the force multiplying gearing system and the other end extending away from the sash;

so that movement of the handle between the first and the second position, causes movement of the force multiplying gearing system and pivotable movement of the operator arm to cause movement of the sash; and wherein the force multiplying gearing system includes a first pinion gear constructed to be rotated by movement of the handle, a first large spur gear rotatably meshed with first pinion gear for rotation, a second small gear journaled to the first large spur gear for rotation therewith, a second large spur gear which forms part of the operator arm and rotatably enmeshed with the second small gear, whereby movement of the handle causes the first pinion gear to rotate, which drives the first large spur gear, the rotation of which rotates the second small gear, which drives the operator arm spur gear.

2. An operator assembly having an operator arm for opening and closing a window having a frame and a sash pivotally secured to the frame for pivoting about an axis associated with the frame and the sash, said operator assembly comprising:

an operator body constructed for securement to a frame, and defining a first and a second position;

an elongated operator arm having one end constructed to engage a sash, the other end gearingly secured to the operator body, and constructed to move in a plane substantially transverse to a frame pivot axis;

a force multiplying gearing system positioned within said body and operatively associated with said other end of the operator arm;

an elongated graspable handle, pivotally mounted within said body for movement between the first and the second position and in a plane substantially parallel to the plane of movement of the operator arm, said handle having one end positioned within the body and operatively associated with the force multiplying gearing system and the other end extending away from the sash;

so that movement of the handle between the first and the second position, causes movement of the force multiplying gearing system and pivotable movement of the operator arm to cause movement of the sash;

wherein the gearing system is operable to move the operator arm between a sash open and a sash closed position and the handle includes an assembly for selective operation of, the operator arm to the open or close position; and wherein there is provided a gear-type rachet wheel mechanism associated with the force multiplying gear system and a pawl mechanism associated the handle and selector assembly so that said handle can be moved in one direction to engage the gearing system but when moved the opposite direction the pawl and gear are gearingly disengaged.

3. An operator assembly as in claim 2 wherein there is provided a locking mechanism to prevent undesired movement of the sash, wherein there is provided a first locking mechanism part associated with the force multiplying gearing system and a second locking mechanism part associated with the operator body and bias for engagement with the first part to prevent movement of the force multiplying system relative to the operator body.

4. An operator assembly as in claim 3 wherein said first part comprises a first gear member associated with the force multiplying gearing system and said second part includes a second gear member constructed and arranged to engage the first gear member.

5. An operator assembly as in claim 3 wherein a biasing member is provided in association with operator body and said second part so as to urge said second part into engagement with said first part.

6. An operator assembly as in claim 5 wherein there is provided a release mechanism associated with the second locking mechanism part and the handle to release the second locking member from engagement with the first locking member only upon movement of the handle.

7. An operator assembly having an operator arm for opening and closing a window having a frame and a sash pivotally secured to the frame for pivoting about an axis associated with the frame and the sash, said operating assembly comprising;

an operator body constructed for securement to a frame, and defining a first and a second position;

an elongated operator arm having one end constructed to engage a sash, the other end gearingly secured in said operator body, and constructed to move in a plane substantially transverse to a frame pivot axis;

a force multiplying gearing system positioned within said body and operatively associated with said other end of the operator arm;

an elongated graspable handle, pivotally mounted in said body for movement between the first and the second position in a plane substantially parallel to the plane of movement of the operator arm, said handle having one end positioned within the body and operatively associated with the force multiplying gearing system and the other end extending away from the sash;

so the movement of the handle between the first and second position causes movement of the force multiplying gear system, and pivotable movement of the operator arm to cause movement of the sash;

wherein there is provided a locking mechanism to prevent undesired movement of the sash and there is provided a first locking mechanism part associated with the force multiplying gearing system and a second locking mechanism part associated with the operator body and biased with the first part to prevent movement of the force multiplying system relative to the operator body; and wherein the first locking mechanism part comprises a first gear member associated with the force multiplying gearing system and the second locking mechanism part is an apertured plate having gear teeth surrounding the aperture which is biased into engagement with the first gear, and a ribbed release plate associated with the handle and engagable with the apertured plate so as to release the teeth from engagement upon movement of the handle.

8. An operator assembly having an operator arm for opening and closing a window having a frame and a sash pivotally secured to the frame for pivoting about an axis associated with the frame and the sash, said operating assembly comprising;

an operating body constructed for securement to a frame, and defining a first and a second position;

an elongated operator arm having one end constructed to engage a sash, the other end gearingly secured in said operator body, and constructed to move in a plane substantially transverse to a frame pivot axis;

a force multiplying gearing system positioned within said body and operatively associated with said other end of the operator arm;

an elongated graspable handle, pivotally mounted in said body for movement between the first and the second position in a plane substantially parallel to the plane of movement of the operator arm, said handle having one end positioned within the body and operatively associated with the force multiplying gearing system and the other end extending away from the sash;

so the movement of the sash between the first and second position causes movement of the force multiplying gear system, and pivotable movement of the operator arm to cause movement of the sash; and wherein there is provided a pawl mechanism mounted to the handle and engagable with the force multiplying gearing system and a selector mechanism associated with the handle so as to selectively urge the pawl into engagement with the gearing system and drive the gearing system in one direction when the handle is moved in a first direction and to release the gearing system when the handle is moved in the reverse direction.

9. An operator assembly as in claim 8 wherein the pawl engages the gearing system to cooperate in driving the operator arm to a sash open position or to a sash closed position.

10. An operator assembly as in claim 9 wherein the selector mechanism includes a selector switch which includes a tipped mechanism engaging the pawl which mechanism is moveable to cause a first tooth of the pawl to engage the gearing system, or to cause a second tooth of the pawl to engage the pawl for driving in a reverse direction.

11. An operator assembly having an operator arm for opening and closing a window having a frame and a sash pivotally secured to the frame for pivoting about an axis associated with the frame and the sash, said operator assembly comprising:

an operator body constructed for securement to a frame, and defining a first and a second position;

an elongated operator arm having one end constructed to engage a sash, and the other end gearingly secured in said operator body;

a force multiplying gearing system positioned within said body and operatively associated with said other end of the operator arm;

an elongated and graspable handle, pivotally mounted within said body for a linear movement between the first and the second position, said handle having one end positioned within the body and operatively associated with the force multiplying gearing system and the other end extending away from the sash;

so that movement of the handle between the first and the second position, causes movement of the force multiplying gear system, and pivotal movement of the operator arm to cause movement of a sash;

wherein the gearing system is operable to move the operator arm between a sash open and a sash closed position and the handle includes an assembly for selective operation of the operator arm to the open or closed position; and wherein there is provided a gear-type ratchet wheel mechanism associated with the force multiplying gear system and a pawl mechanism associated with the handle and selector assembly so that said handle can be moved in one direction to engage the gearing system but when moved in the opposite direction the pawl and gear system are gearingly disengaged.

12. An operator assembly having an operator arm for opening and closing a window having a frame and a sash pivotally secured to the frame for pivoting about an axis associated with the frame and the sash, said operator assembly comprising:

an operator body constructed for securement to a frame, and defining a first and a second position;

an elongated operator arm having one end constructed to engage a sash, and the other end gearingly secured in said operator body;

a force multiplying gearing system positioned within said body and operatively associated with said other end of the operator arm;

an elongated and graspable handle, pivotally mounted within said body for a linear movement between the first and the second position, said handle having one end positioned within the body and operatively associated with the force multiplying gearing system and the other end extending away from the sash;

so that movement of the handle between the first and the second position, causes movement of the force multiplying gear system, and pivotal movement of the operator arm to cause movement of a sash; and wherein the force multiplying gearing system includes a first pinion gear constructed to be rotated by movement of the handle, a first large spur gear rotatably meshed with said first pinion gear for rotation, a second small gear journalled to the first large spur gear for rotation therewith, and a second large spur gear which forms part of the operator arm and rotatably enmeshed with said second small gear, whereby movement of the handle causes the first pinion gear to rotate, which drives the first large spur gear, the rotation of which rotates the second small gear, which drives the operator arm spur gear.

13. An operator assembly having an operator arm for opening and closing a window having a frame and a sash pivotally secured to the frame for pivoting about an axis associated with the frame and the sash, said operator assembly comprising:

an operator body constructed for securement to a frame, and defining a first and a second position;

an elongated operator arm having one end constructed to engage a sash, and the other end gearingly secured in said operator body;

a force multiplying gearing system positioned within said body and operatively associated with said other end of the operator arm;

an elongated and graspable handle, pivotally mounted within said body for a linear movement between the first and the second position, said handle having one end positioned within the body and operatively associated with the force multiplying gearing system and the other end extending away from the sash;

so that movement of the handle between the first and the second position, causes movement of the force multiplying gear system, and pivotal movement of the operator arm to cause movement of a sash;

wherein there is provided a locking mechanism to prevent undesired movement of a sash, wherein there is provided a first locking mechanism part associated with the force multiplying gearing system and a second locking mechanism part associated with the operator body and biased for engagement with the first part to prevent movement of the force multiplying system relative to the operator body; and wherein the first locking mechanism part comprises a first gear member associated with the force multiplying gearing system and the second locking mechanism part is an apertured plate having gear teeth surrounding the aperture which is biased into engagement with the first gear, and a ribbed release plate associated with the handle and engagable with the apertured plate so as to release the teeth from engagement upon movement of the handle.

14. An operator assembly having an operator arm for opening and closing a window having a frame and a sash pivotally secured to the frame for pivoting about an axis associated with the frame and the sash, said operator assembly comprising:

an operator body constructed for securement to a frame, and defining a first and a second position;

an elongated operator arm having one end constructed to engage a sash, and the other end gearingly secured in said operator body;

a force multiplying gearing system positioned within said body and operatively associated with said other end of the operator arm;

an elongated and graspable handle, pivotally mounted within said body for a linear movement between the first and the second position, said handle having one end positioned within the body and operatively associated with the force multiplying gearing system and the other end extending away from the sash;

so that movement of the handle between the first and the second position, causes movement of the force multiplying gear system, and pivotal movement of the operator arm to cause movement of a sash; and wherein there is provided a pawl mechanism mounted to the handle and engagable with the force multiplying gearing system and a selector mechanism associated with the handle so as to selectively urge the pawl into engagement with the gearing system and drive the gearing system in one direction when the handle is moved in a first direction and to release the gearing system when the handle is moved in the reverse direction.

15. An operator assembly as in claim 14 wherein a pawl engages the gearing system to cooperate in driving the operator arm to a sash open position or to a sash closed position.

16. An operator assembly as in claim 15 wherein the selector mechanism includes a selector switch which includes a tipped mechanism engaging the pawl which mechanism is moveable to cause a first tooth of the pawl to engage the gearing system, or to cause a second tooth of the pawl to engage the pawl for driving in a reverse direction.

17. An operator assembly having an operator arm for opening and closing a window having a frame and a sash pivotally secured to the frame for pivoting about an axis associated with the frame and the sash, said operator assembly comprising:

an operator body constructed for securement to a frame, and defining a first and a second position, an elongated operator arm having one end constructed to engage a sash and the other end gearingly secured in said operator body and constructed to move in a plane substantially transverse to a sash/frame pivot axis, a force multiplying gearing system positioned within said body and operatively associated with said other end of the operator arm, an elongated and graspable handle, pivotally mounted within said body for movement between the first and the second position and in a plane substantially parallel to the plane of movement of the operator arm, said handle having one end positioned within the body and operatively associated with the force multiplying gearing system and the other end extending away from the sash, so that movement of the handle between the first and the second position, causes movement of the force multiplying gear system, and pivotal movement of the operator arm to cause movement of a sash;

wherein the gearing system is operable to move the operator arm between a sash open and a sash closed position and the handle includes an assembly for selective operation of the operator arm to the open or closed position;

wherein there is provided a gear-type ratchet wheel mechanism associated with the force multiplying gear system and a pawl mechanism associated with the handle and selector assembly so that said handle can be moved in one direction to engage the gearing system but when moved in the opposite direction the pawl and gear are gearingly disengaged;

wherein the force multiplying gearing system includes a first pinion gear constructed to be rotated by movement of the handle, a first large spur gear rotatably meshed with said first pinion gear for rotation, a second small gear journalled to the first large spur gear for rotation therewith, and a second large spur gear which forms part of the operator arm and rotatably enmeshed with said second small gear, whereby movement of the handle causes the first pinion gear to rotate, which drives the first large spur gear, the rotation of which rotates the second small gear, which drives the operator arm spur gear;

wherein there is provided a locking mechanism to prevent undesired movement of a sash, wherein there is provided a first locking mechanism part associated with the force multiplying gearing system and a second locking mechanism part associated with the operator body and biased for engagement with the first part to prevent movement of the force multiplying system relative to the operator body;

wherein a biasing member is provided in association with operator body and said second part so as to urge said second part into engagement with said first part;

wherein said first part comprises a first gear member associated with the force multiplying gearing system and said second part includes a second gear member constructed and arranged to engage the first gear member;

wherein there is provided a release mechanism associated with the second locking mechanism part and the handle to release the second locking member from engagement with the first locking member only upon movement of the handle;

wherein the first locking mechanism part comprises a first gear member associated with the force multiplying gearing system and the second locking mechanism part is an apertured plate having gear teeth surrounding the aperture which is biased into engagement with the first gear, and a ribbed release plate associated with the handle and engagable with the apertured plate so as to release the teeth from engagement upon movement of the handle;

wherein the handle is moveable substantially parallel to the frame in which the operator body is secured;

wherein there is provided a pawl mechanism mounted to the handle and engagable with the force multiplying gearing system and a selector mechanism associated with the handle so as to selectively urge the pawl into engagement with the gearing system and drive the gearing system in one direction when the handle is moved in a first direction and to release the gearing system when the handle is moved in the reverse direction;

wherein the pawl engages the gearing system to cooperate in driving the operator arm to a sash open position or to a sash closed position; and wherein the direction selector mechanism includes a selector switch which includes a tipped mechanism engaging the pawl which mechanism is moveable to cause a first tooth of the pawl to engage the gearing system, or to cause a second tooth of the pawl to engage the pawl for driving in a reverse direction.

* * * * *